US007934271B2

(12) United States Patent
Soller et al.

(10) Patent No.: US 7,934,271 B2
(45) Date of Patent: May 3, 2011

(54) TOILET BOWL TREATING ASSEMBLY

(75) Inventors: Douglas A. Soller, Racine, WI (US); Michael C. Fryan, Racine, WI (US); Matthew N. Thurin, Wauwatosa, WI (US); Kevin L. Askling, Madison, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 469 days.

(21) Appl. No.: 12/204,878

(22) Filed: Sep. 5, 2008

(65) Prior Publication Data

US 2009/0056004 A1 Mar. 5, 2009

Related U.S. Application Data

(60) Provisional application No. 60/970,144, filed on Sep. 5, 2007.

(51) Int. Cl.
*E03D 9/02* (2006.01)

(52) U.S. Cl. ..... 4/223; 4/230; 4/222

(58) Field of Classification Search ..... 4/230, 229, 4/222, 223; 220/87.1, 87.2
See application file for complete search history.

(56) References Cited

U.S. PATENT DOCUMENTS

| | | | | |
|---|---|---|---|---|
| 713,978 | A | 11/1902 | Gallagher | |
| 749,963 | A | 1/1904 | Gallagher | |
| 979,386 | A | 12/1910 | Druzbach | |
| 988,178 | A | 3/1911 | Druzbach | |
| 2,950,959 | A * | 8/1960 | Ve Relle | 4/222 |
| 3,410,455 | A | 11/1968 | Haas | |
| 3,840,914 | A | 10/1974 | Tufts et al. | |
| 3,845,882 | A | 11/1974 | Hass | |
| 3,942,683 | A | 3/1976 | Haas | |
| 3,968,902 | A | 7/1976 | Bachmann | |
| 4,216,553 | A | 8/1980 | Haberle | |
| 4,819,276 | A | 4/1989 | Stevens | |
| 4,966,305 | A | 10/1990 | Hinterreiter | |
| 5,984,285 | A | 11/1999 | Konig et al. | |
| 6,745,417 | B2 | 6/2004 | Sumino | |
| 2006/0097189 | A1 | 5/2006 | Lim | |
| 2008/0244813 | A1 * | 10/2008 | Looft | 4/223 |

FOREIGN PATENT DOCUMENTS

| | | | |
|---|---|---|---|
| DE | 2807011 | A1 | 8/1979 |
| DE | 102005001794 | A1 | 4/2006 |
| EP | 1505215 | A | 2/2005 |

OTHER PUBLICATIONS

PCT/US2008/010398 International Search Report and Written Opinion dated Oct. 22, 2009.

* cited by examiner

*Primary Examiner* — Khoa D Huynh

(57) ABSTRACT

Toilet bowl treating/cleaning assemblies are provided. In one form the toilet seat lid has mounted on it a dispenser in a fashion so that pivoting of the lid assists in controlling dispensing of a solid pill containing a treating chemical. Also, structures are provided to avoid dispensing when a consumer determines that bowl treatment is not needed, and to facilitate dispensing in response to manual activation.

9 Claims, 5 Drawing Sheets

TOILET BOWL TREATING ASSEMBLY

CROSS-REFERENCE TO RELATED APPLICATIONS

This application claims priority based on U.S. provisional application 60/970,144, filed on Sep. 5, 2007.

STATEMENT REGARDING FEDERALLY SPONSORED RESEARCH/DEVELOPMENT

Not applicable.

BACKGROUND OF THE INVENTION

The present invention relates to devices for dispensing toilet bowl treating chemicals (e.g. soaps, disinfectants, sanitizers deodorizers, fragrances, colorants, etc.). More specifically it relates to such devices that allow a consumer to direct when the chemicals will be dispensed into the toilet bowl water, while minimizing the need for consumers to scrub the toilet bowl.

Toilet bowls require care to prevent the buildup of unsightly deposits, to reduce odors and to prevent bacteria growth. Originally toilet bowls were cleaned, deodorized and/or otherwise treated by manual scrubbing with a liquid or powdered cleaning/sanitizing agent that was added to the bowl water by hand. This required manual labor to keep the toilet bowl clean.

To reduce or in some cases eliminate the need for manual scrubbing, various automatic toilet bowl cleaning systems have been created. One type of system delivers the cleaning chemical by adding it to the flush water while the flush water was still stored in the toilet tank. Some embodiments of this type of system add the chemical to the flushing cycle in liquid form. Others place a block of cleaning chemical in the toilet tank, to slowly dissolve over several weeks or longer.

However, a system which relies on adding the chemical to the storage tank typically requires the consumer to lift a tank lid in order to install the device and/or to add a new charge/block of cleaning chemical. Also, with some of such systems, precise control over the quantity of chemical to be delivered is difficult. For example, different water hardness from the supply may cause different cleaning blocks to dilute at different rates. Further, when the chemical is placed in the storage tank the cleaning chemical must be compatible for long-term contact with some of the valving present in the toilet tank, which may impose some limitations.

An alternative type of system hangs a dispenser adjacent and/or immediately under the toilet bowl rim. Water flowing from the rim washes over the dispenser, thereby triggering dispensing of the stored chemical directly into the bowl water. However, some consumers prefer not to have the ornamental exterior of their toilet disrupted by the presence of a hook hanger. Still others are reluctant to maintain such dispensers given that they are so close to the waste bowl, and the consumers don't want to reach near that area.

In any event, such systems are designed to dispense in response to each flush. In some situations where increased amounts of flushing are occurring (e.g., a curious child, a large number of guests, a family's return from a long car-trip) cleaning chemicals may not be necessary after every flushing. Thus, some of these systems use up more cleaning chemicals than is actually needed.

There have been attempts to associate toilet bowl chemical dispensers with the lids or other coverings of toilets, or near them. See e.g. U.S. Pat. Nos. 713,978, 749,963, 979,386, 988,178, 3,840,914, 4,216,553, 4,819,276 and 6,745,417, and U.S. patent application publication 2006/0097189. However, these systems suffer from many of the deficiencies noted above. For example, it is typical with many of such systems to have dispensing occur with every lid movement, regardless of need.

It can therefore be seen that improvements are desired with respect to toilet bowl cleaning assemblies that dispense cleaning chemicals.

BRIEF SUMMARY OF THE INVENTION

In one aspect the invention provides a toilet bowl treating assembly comprising a cover suitable to be pivotably mounted to a rearward portion of the toilet bowl so as to pivot between a somewhat upright position and an essentially horizontal position. There is also a dispenser mounted to the cover and having an outlet on an underside of the cover, and a plurality of solid pills stored in the dispenser so as to be dispensable there from. At least one of the pills comprises a toilet treatment chemical, and, when the cover is so mounted, pivoting of the cover to the upright position can restrict dispensing of a pill. For example, the toilet treatment chemical could include surfactants, fragrances and colorants, and mixtures thereof.

The cover can be selected from the group consisting of toilet seats and toilet lids, with lids being preferred. In preferred embodiments there can be an actuator for moving a pill in response to a manual force having been applied to the actuator. The actuator is linked to a return spring such that after it is caused to move a pill, the spring will cause the actuator to move back to a rest position.

When the cover is down, and the actuator used, gravity can assist in driving a pill out the outlet. The pills are preferably stored in a waiting line that is either serpentine or in the form of a stack with adjacent pills abutting each other in face-to-face fashion. Most preferably, the pills can be stored in a cartridge unit which can be separated from the dispenser when the pills have all been dispensed from the dispenser.

By the term "pill" it is intended to mean a solid mass of a size larger than what would be viewed as powder, regardless of shape. Hence, the pills may be disk shaped, or spherical, or elongated, or have other configurations. Tablet shapes are most preferred.

In one alternative embodiment, pivoting the cover from the somewhat upright position to the essentially horizontal position dispenses a pill automatically to the toilet bowl when the pill has previously been positioned in a "ready" position of the dispenser. The assembly may have an actuator for moving a pill from a storage area of the dispenser to the ready position in response to a manual force having been applied to the actuator. The actuator could be in the form of a slide for driving a lower one of the pills to the ready position, and the ready position may be in the form of a delivery slot. The actuator may also contain a lock which can, when activated, inhibit use of the actuator to move a pill to the ready position.

Once a pill has reached the ready position in this embodiment, and the cover has been positioned so as to extend essentially horizontally, gravity will drive the pill out the delivery slot. Thus, when a consumer closes the lid after using the toilet, if the pill has been pre-positioned in the ready position the movement of the lid causes the bowl to be treated. However, if the consumer thinks the bowl is sufficiently clean, and doesn't pre-position the pill to the ready position, no dispensing will take place.

The foregoing and other advantages of the present invention will be apparent from the following description. In that description reference is made to the accompanying drawings which form a part thereof, and in which there is shown by way of illustration, and not limitation, preferred embodiments of the invention. Such embodiments do not necessarily represent the full scope of the invention.

DETAILED DESCRIPTION OF THE INVENTION

Figure 1:
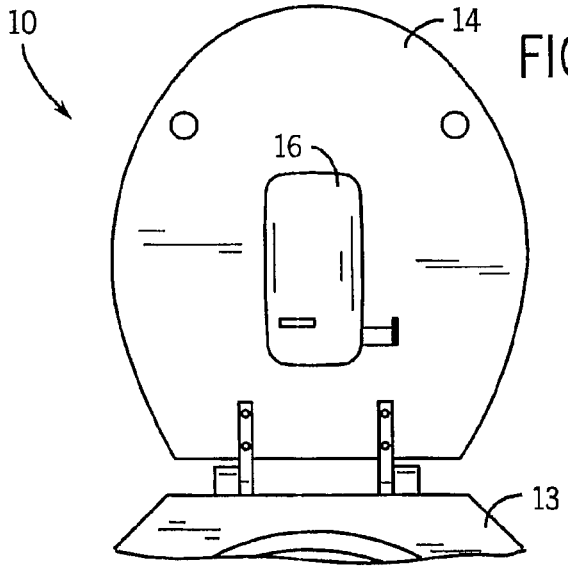
FIG. 1 is a front view of a toilet seat assembly which includes a dispenser of the present invention.
Figure 2:
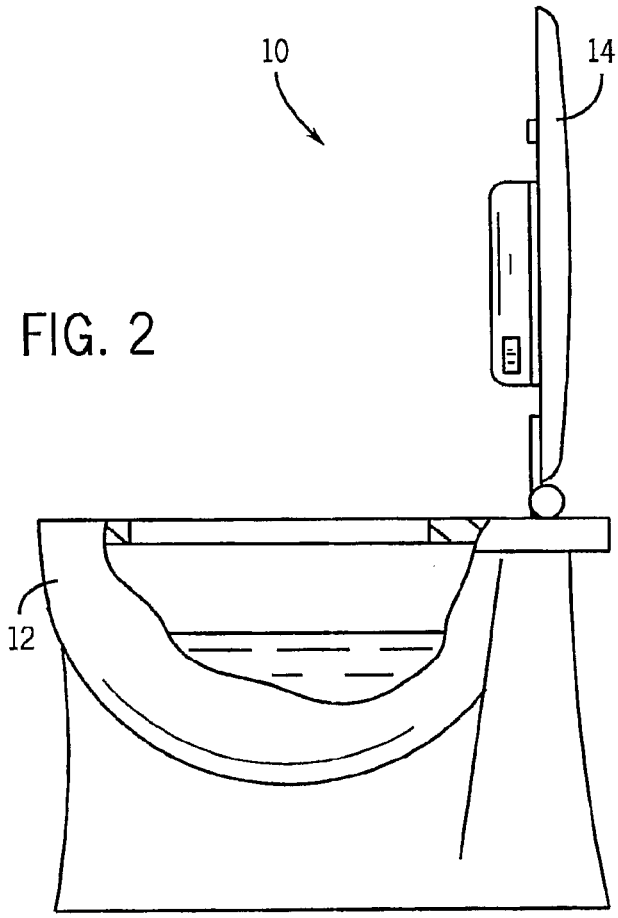
FIG. 2 is a fragmentary side view of a toilet on which an embodiment of the present invention has been mounted.
Figure 3:
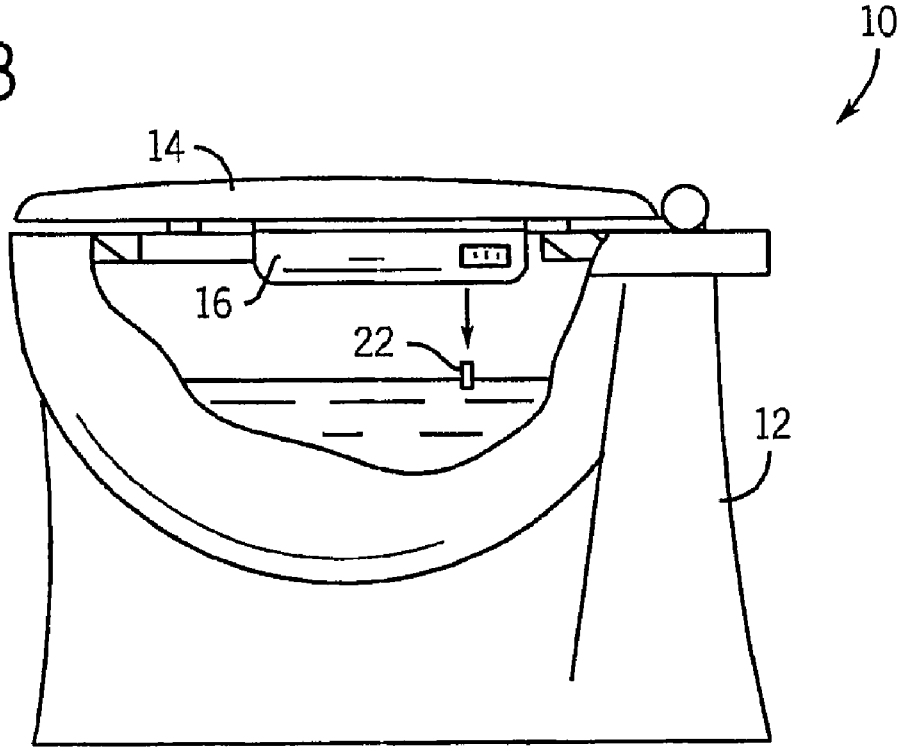
FIG. 3 is a view similar to FIG. 2, but with the lid shown in the horizontal position; side view of the cleaning assembly of FIG. 1, albeit with the cover in the essentially horizontal position.

Referring now to FIGS. 1-3, numeral 10 refers to the dispenser assembly as installed at a rearward end of a toilet bowl 12. There is a toilet seat 13 and toilet seat cover or lid 14. In accordance with the present invention there is also a dispenser 16 mounted on an under/forward side of the toilet seat cover 14.

Figure 4:
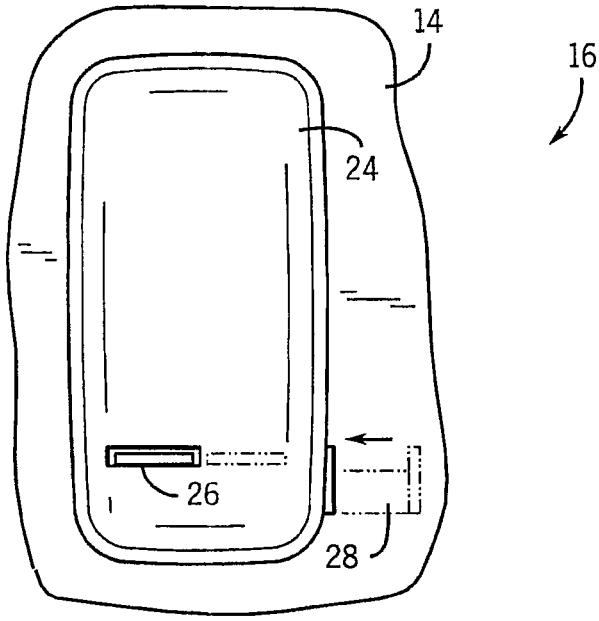
FIG. 4 is an enlarged view of the dispenser portion of FIG. 1, albeit with an indication of the effect of actuator movement.

The cover 14 is pivotably mounted to the toilet bowl 12 so as to pivot between an at least somewhat upright position as shown in FIGS. 1 and 2. This position is usually defined by a tank or other wall against which the cover rests. As shown in FIG. 3, from that position the dispenser 16 may dispense a pill 22 into the toilet bowl 12 if, as shown in FIG. 4, the pill has previously been positioned in a ready position.

Figure 5:
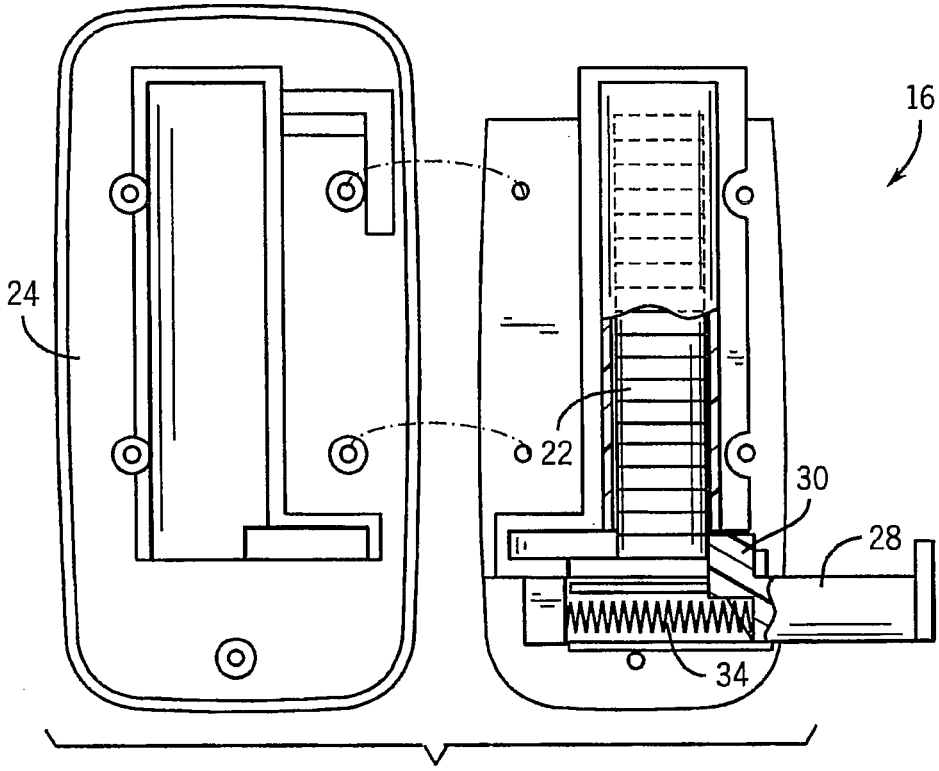
FIG. 5 is a further enlarged view of the FIG. 4 dispenser, but with its cover separated from its main body, and with the actuator shown in its rest position.
Figure 6:
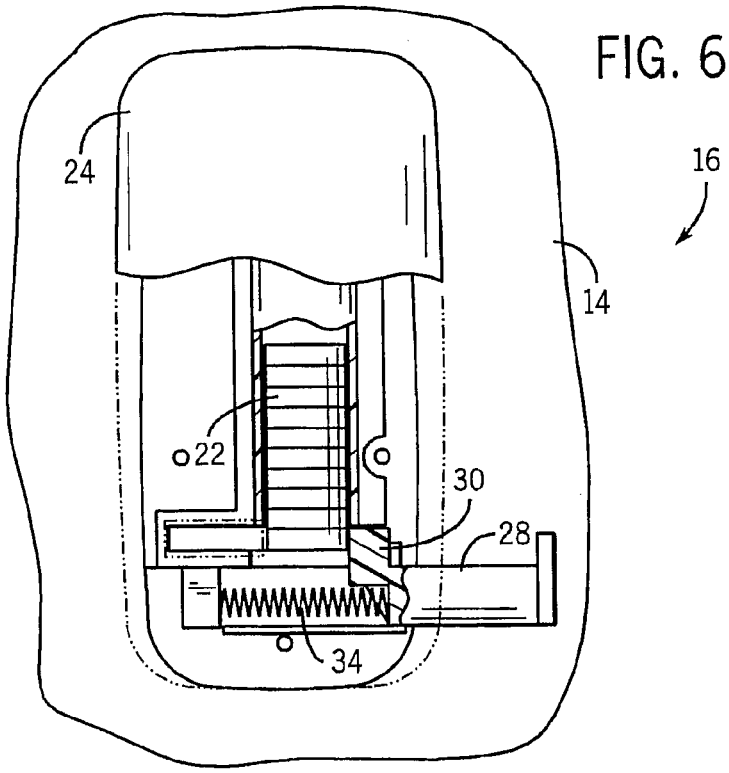
FIG. 6 is a view similar to FIG. 4, but with the cover of the dispenser partially fragmented, and the actuator in its rest position.
Figure 7:
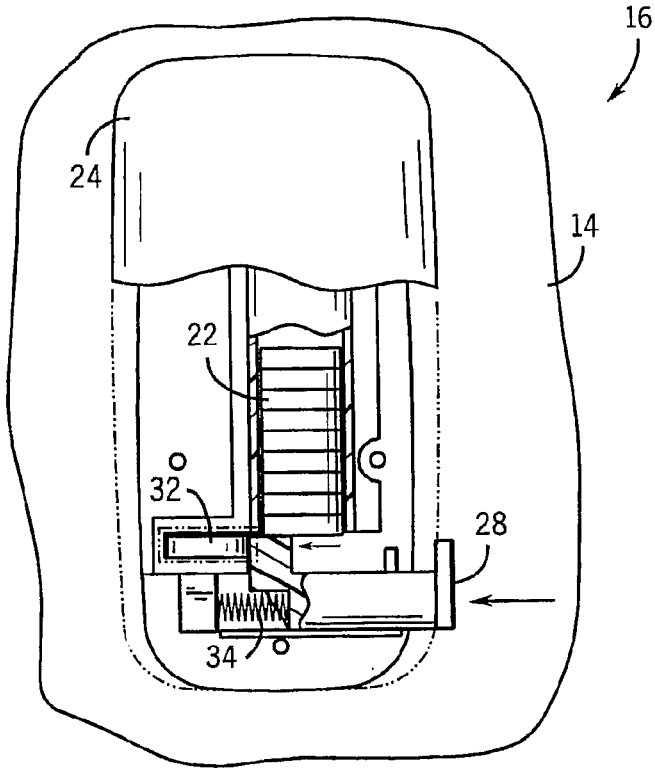
FIG. 7 is a view similar to FIG. 6, but with the actuator shown having driven a pill to its ready position.
Figure 9:
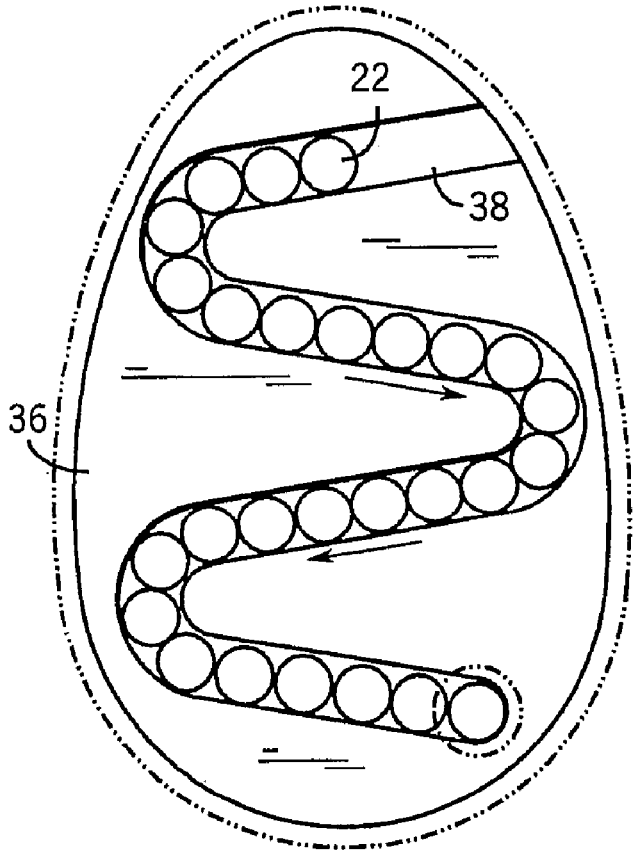
FIG. 9 is a schematic view of an internal cavity thereof. 8, albeit with the dispenser cover off.

As shown in FIG. 5 (or alternatively FIG. 9) the dispenser 16 will store a plurality of solid pills 22. In FIG. 5 the pills are stacked face-to-face and are disk-like. In FIG. 9 the pills are positioned end-to-end are may be disk-like or spherical.

Referring next to FIGS. 4-7, the dispenser 16 has a two-part outer housing 24 with a delivery slot 26 therein. There is also an actuator 28 which can drive the lowermost pill 22 from a storage area 30 of the dispenser 16 to a ready position 32 adjacent the delivery slot 26, in response to a manual force having been applied to the actuator 28 against the pressure of a return spring 34. After the actuator moves a pill to the ready position 32, the spring 34 causes the actuator 28 to move back to a rest position.

The actuator 28 is preferably in the form of a slide. The actuator 28 may also contain a lock (not shown) which can, when activated, inhibit use of the actuator 28 to move a pill 22 to the ready position. For example, the actuator could be rotatable such that projection 35 moves away from a driving position if desired.

When the toilet cover 14 is pivoted into the essentially horizontal position 20, the dispenser 16 is moved down into an essentially horizontal position above the toilet bowl 12. Once the dispenser 16 is in this position, the pill 22 in the ready position is automatically dispensed into the toilet bowl 12 as gravity drives the pill 22 out the delivery slot 26.

In this manner, a user can determine when cleaning chemicals are to be automatically dispensed into the toilet bowl 12. For example, if the actuator is not used, no pill will be in the ready position, and no pill will be dispensed.

As shown in FIG. 5, the pills 22 can be stored in a cartridge unit. This can be separated from the dispenser 16 when the pills have all been dispensed from the dispenser 16. Hence, only the cartridge unit need be disposed of.

Figure 8:
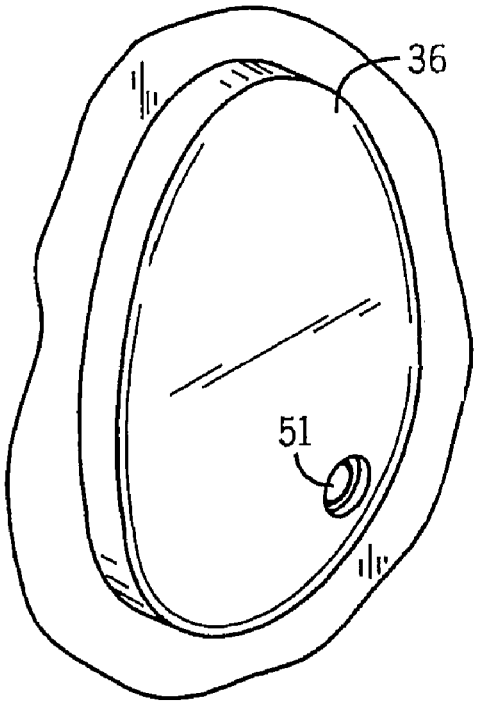
FIG. 8 is a perspective view of an alternate embodiment of a dispenser.

Referring next to FIGS. 8-9, an alternative embodiment of the present invention is shown. In this embodiment, the dispenser 16 has a somewhat different external housing shape 36. More importantly, here there is no actuator. Rather, there is a serpentine waiting path 38 within the dispenser 16, with the pills 22 stored in a row abutting each other in edge-to-edge fashion (somewhat like an automated vendor path). Here, the next pill simply rolls to the ready position after one is dispensed and the lid is raised.

To provide greater control over dispensing, one could provide a threaded cap or snap cap (not shown) over the dispensing hole 51 if one didn't want vending. Hence, in this embodiment, the positioning to the ready position occurs via gravity, and a manual cap placement prevents vending if desired.

The pills 22 may be any conventional toilet bowl cleaning tablet material, or other treating formulations. Most preferably, the pills will contain surfactants, bleaches, disinfectants, fragrances, builders, colorants and/or any combination thereof. The cleaning chemicals should preferably be capable of removing lime and unwanted stains. The exact formulation is not critical except that the pill should not be so sticky as to impede dispensing.

For example, a pill could be based on one of the denture cleanser tablet formulations described in U.S. Pat. No. 5,384,062 (e.g. perborate based with a talc lubricant and a polytetrafluoroethylene compression aid).

While embodiments of the present invention have been described, other embodiments of the invention are within the spirit and scope of this disclosure. For example, some consumers may prefer a smoother underside to the lid (e.g. for the perceived benefit of using the lid as a back rest, or for aesthetic reasons). Hence, the dispenser may be housed within the lid with only a small outlet slot visible to consumers along the underside. With this embodiment, the actuator could be positioned elsewhere on the lid.

Further, while it is desirable that there be automatic inhibition of dispensing when the lid is in the up position, the means of achieving this (while also permitting dispensing when the lid is down) may vary from embodiment to embodiment. Hence, the claims, when presented, should not be construed as being limited to just the disclosed preferred embodiments.

INDUSTRIAL APPLICABILITY

The present invention provides devices for delivering toilet treating chemicals to toilet bowls in a consumer-controlled fashion.

What is claimed is:

1. A toilet bowl treating assembly, comprising:

a cover suitable to be pivotably mounted to a rearward portion of the toilet bowl so as to pivot between a somewhat upright position and an essentially horizontal position;

a dispenser mounted to the cover and having an outlet on an underside of the cover;

a plurality of solid pills stored in the dispenser so as to be dispensable there from, wherein at least one of the pills comprises a toilet treating chemical;

whereby when the cover is so mounted, pivoting of the cover to the somewhat upright position can restrict dispensing of a pill;

wherein the assembly further comprises a manually movable actuator for moving a pill laterally with respect to the cover under a reservoir of pills in response to a manual force having been applied to the actuator, to move a pill to a ready to dispense position.

2. The assembly of claim 1, wherein the toilet treating chemical comprises a chemical selected from the group consisting of surfactants, fragrances and colorants.

3. The assembly of claim 1, wherein the cover is selected from the group consisting of toilet seats and toilet lids.

4. The assembly of claim 1, wherein the actuator is linked to a return spring such that after it is caused to move a pill, the return spring will cause the actuator to move back to a rest position.

5. The assembly of claim 1, wherein gravity can assist in driving the pill out the outlet.

6. The assembly of claim 1, wherein the pills are in tablet form.

7. A toilet bowl treating assembly, comprising:

a cover suitable to be pivotably mounted to a rearward portion of the toilet bowl so as to pivot between a somewhat upright position and an essentially horizontal position;

a dispenser mounted to the cover and having an outlet on an underside of the cover;

a plurality of solid pills stored in the dispenser so as to be dispensable there from, wherein at least one of the pills comprises a toilet treating chemical;

whereby when the cover is so mounted, pivoting of the cover to the somewhat upright position can restrict dispensing of a pill;

wherein the pills are stored in a waiting line that is serpentine in the form of a contoured W.

8. The assembly of claim 1, wherein the pills are stored in a stack with adjacent pills abutting each other in face-to-face fashion.

9. The assembly of claim 1, wherein the pills are stored in a cartridge unit which can be separated from the dispenser when the pills have all been dispensed from the dispenser.

* * * * *